US008070001B2

(12) United States Patent
Meyer et al.

(10) Patent No.: US 8,070,001 B2
(45) Date of Patent: Dec. 6, 2011

(54) TWO PIECE DRAFT GEAR HOUSING HAVING A INTEGRAL YOKE

(75) Inventors: David Meyer, River Forest, IL (US); Howard Sommerfeld, Oak Forest, IL (US); Michael E. Ring, Saint John, IN (US)

(73) Assignee: WABTEC Holding Corp, Wilmerding, PA (US)

( * ) Notice: Subject to any disclaimer, the term of this patent is extended or adjusted under 35 U.S.C. 154(b) by 219 days.

(21) Appl. No.: 12/501,591

(22) Filed: Jul. 13, 2009

(65) Prior Publication Data

US 2010/0000956 A1 Jan. 7, 2010

Related U.S. Application Data

(62) Division of application No. 11/174,677, filed on Jul. 5, 2005, now Pat. No. 7,588,154.

(51) Int. Cl.
*B61G 7/00* (2006.01)

(52) U.S. Cl. ..... 213/50; 213/65; 213/69; 213/24; 213/31

(58) Field of Classification Search ..... 213/9, 22, 213/23, 24, 31, 32 R, 33, 34, 32 B, 32 C, 213/35, 36, 60, 50, 61, 65, 67 R, 69, 70, 71, 213/72, 7, 12, 18, 26, 40 R, 44, 45, 51, 56, 213/62 R, 62 A, 64

See application file for complete search history.

(56) References Cited

U.S. PATENT DOCUMENTS

| | | | | |
|---|---|---|---|---|
| 1,877,399 | A * | 9/1932 | Hewitt | 213/30 |
| 1,979,524 | A * | 11/1934 | Barrows | 213/30 |
| 3,447,693 | A | 6/1969 | Cardwell | |
| 6,446,820 | B1 * | 9/2002 | Barker et al. | 213/75 R |

* cited by examiner

*Primary Examiner* — Mark Le
(74) *Attorney, Agent, or Firm* — James Ray & Assoc

(57) ABSTRACT

A housing for a railway car draft gear assembly for cushioning buff and draft shocks includes a rear portion engageable with the rear stops of such railway car and a front portion configured for attachment to a coupler arm. Opposed ends of the front and rear portions are provided with complimentary flanges for removable attachment of the front portion to the rear portion with threaded fasteners.

6 Claims, 3 Drawing Sheets

TWO PIECE DRAFT GEAR HOUSING HAVING A INTEGRAL YOKE

CROSS-REFERENCE TO RELATED APPLICATIONS

This application is a Divisional Application and claims priority from U.S. patent application Ser. No. 11/174,677 filed Jul. 5, 2005 now U.S. Pat. No. 7,588,154.

This application is also closely related to each of U.S. Utility Pat. No. 7,264,130, issued Sep. 4, 2007, U.S. Utility Pat. No. 7,175,036 issued Feb. 13, 2007, U.S. Utility Pat. No. 7,097,055 issued Aug. 29, 2006, and U.S. Utility Pat. No. 7,281,635 issued Oct. 16, 2007. These patents are assigned to the assignee of the present invention and the disclosures of these related patents are incorporated herein by reference thereto.

FIELD OF THE INVENTION

The present invention relates, in general, to draft gear assemblies for use in cushioning both buff and draft shocks normally encountered by railroad rolling stock during make-up and operation of a train consist on a track structure and, more particularly, this invention relates to a draft gear assembly having a two piece housing with an integrated yoke.

BACKGROUND OF THE INVENTION

Draft gear assemblies are widely used in the railroad industry to provide protection to a railway car by absorbing shocks in both draft and buff conditions. They are installed in alignment with a railway car center sill having a pair of front stops and a pair of opposed rear stops that form a draft gear pocket and cooperate with a separate yoke member attached to a coupler of such railway car. It is well known that various railroads now use a standard draft gear pocket of 24.62 inches in length. As a result, it has been mandated that draft gear assemblies of different designs must fit into such standard draft gear pocket.

It has been further mandated and accepted to provide a standard draft gear assembly for use with a 24.62 inch long pocket which is capable of 3.25 inch travel in both buff and draft directions.

Lately, draft gear assemblies having an integrated yoke have been gaining acceptance in various railway applications. The draft gear assemblies with an integrated yoke have a number of advantages. One advantage is that they fit into a smaller pocket and its adjacent areas in the freight railway car or provide for a higher shock absorbing capacity and longer travel when installed into a standard 24.625 inch long pocket.

Another advantage is that they offer reduced weight and can be delivered from a manufacturer in a fully assembled condition ready for immediate installation and reduce the need for a railroad to procure a separate yoke and shock absorbing member.

Related patent applications teach one type of draft gear assembly with an integral yoke that utilizes a friction-type cushioning and release mechanism. A compressible cushioning element of such friction-type draft gear assembly is positioned within the rear portion of the housing, while a friction cushioning element is disposed in the front portion of the housing. A spring release mechanism for continuously urging the friction cushioning element outwardly from the compressible cushioning element thereby releasing such friction cushioning element after compression of such draft gear. The compressible cushioning element is typically either of an all coil spring configuration as taught in U.S. Pat. Nos. 5,152,409, 5,529,194 and 5,590,797 or of a coil spring and hydraulic assembly combination as taught in U.S. Pat. No. 3,368,698.

U.S. Pat. No. 6,446,820 to Barker et al. teaches another type of draft gear assembly with an integral yoke that has a front resilient compressible elastomeric pad stack and a coupler follower disposed within the yoke portion and a rear resilient compressible elastomeric pad stack disposed intermediate the rear portion of the yoke and the rear follower. A center rod extends through the yoke, the rear resilient compressible elastomeric pad stack and the rear follower.

It has been accepted that, due to wear, the yoke portion must be reconditioned about every 8 years, while the remaining housing portion, particularly in the friction-type draft gear assemblies may be reconditioned about every 16 years. Therefore, a disadvantage of the friction-type draft gear assemblies with an integrated yoke is that the entire assembly must be sent back to the manufacturer for reconditioning thus increasing the complexity and cost of such reconditioning.

It has been further accepted that coupler types presently in use vary between different railroads and car manufacturers with E-shank, F-shank and rotary shank couplers being the most widely used coupler types. Therefore, another disadvantage of the draft gear assembly with an integral yoke member is that it must be configured for use with a particular type of coupler which increases the complexity and cost to interchange the cars with different couplers within a train consist.

SUMMARY OF THE INVENTION

The present invention provides a housing for a railway car draft gear assembly for cushioning buff and draft shocks that are usually encountered in such railway car rolling stock during a coupling operation of such railway car to a train consist and during normal operation of such train consist on a track structure, such buff and draft shocks transmitted by a coupler of such railway car. The draft gear assembly is disposed within a center sill of such railway car between a pair of front stops and an opposed pair of rear stops. The housing includes a rear portion having each of a predetermined shape and a predetermined length and having a first end and an axially opposed second end oriented towards such pair of rear stops. An axially opposed front portion has a first end and an axially opposed generally open second end adapted for receiving and attaching a coupler arm. The first end of each of the front and rear portion is provided with outwardly extending complimentary flanges for removable attachment of the front portion to the rear portion with threaded fasteners thus enabling ease of removal and replacement of the front portion which is configured as a well known yoke. According to one embodiment of the invention, such first end of each of the front and rear portion is generally open. The rear portion includes a positioning means engageable with an inner surface of an end wall of the second end for centrally maintaining one end of a compressible cushioning element disposed in the second end during compression and extension of the compressible cushioning element. The compressible cushioning element extends longitudinally from the inner surface of the end wall into the rear portion. The compressible cushioning element includes at least one resilient compression member which may be one of a spring element, hydraulic assembly, elastomeric pad stack, and various combinations thereof. Either the first end of the front portion or the first end of the rear portion receives a seat means having at least a portion of one surface thereof abutting an axially-opposite end of the compressible cushioning element and mounted to move longitudinally within the housing for respectively compressing and releasing the compressible cushioning element during application and release of a force exerted on such draft gear assembly. There is a friction cushioning means engageable with such seat means for absorbing energy during a compression of such draft gear assembly and a spring release means engaging and longitudinally extending between the seat means and the friction cushioning means for continuously urging the friction cushioning means outwardly from the compressible cushioning element to release the friction cushioning means when an applied force compressing such draft gear assembly is removed.

According to another embodiment of the invention, each of the first and second end of the rear portion is a plate like member caging at least one resilient compression member with aid of a center rod extending from the second end of the rear portion through such at least one resilient compression member and through the first end of the rear portion. The at least one resilient compression member is formed by a plurality of elastomeric pads. A second resilient compression member is disposed within the front portion.

OBJECTS OF THE INVENTION

It is therefore one of the primary objects of the present invention to provide a draft gear assembly having a two piece housing with a removable yoke portion which protects a railway car by absorbing shocks in both draft and buff conditions.

A further object of the present invention is to provide a draft gear assembly having a two piece housing with a removable yoke portion which achieves a higher shock absorbing capacity.

Yet a further object of the present invention is to provide a draft gear assembly having a two piece housing with a removable yoke portion which achieves a higher shock absorbing capacity and a longer travel distance.

Another object of the present invention is to provide a draft gear assembly having a two piece housing with a removable yoke portion which reduces reconditioning costs.

Yet another object of the present invention is to provide a draft gear assembly having a two piece housing with a removable yoke portion which has a reduced weight.

An additional object of the present invention is to provide a draft gear assembly having a two piece housing with a removable yoke portion which is adapted for use with various coupler types.

These and various other objects and advantages to the present invention will become more apparent to those persons skilled in the relevant art from the following more detailed description, particularly, when such description is taken in conjunction with the attached drawings and the appended claims.

Figure 1:
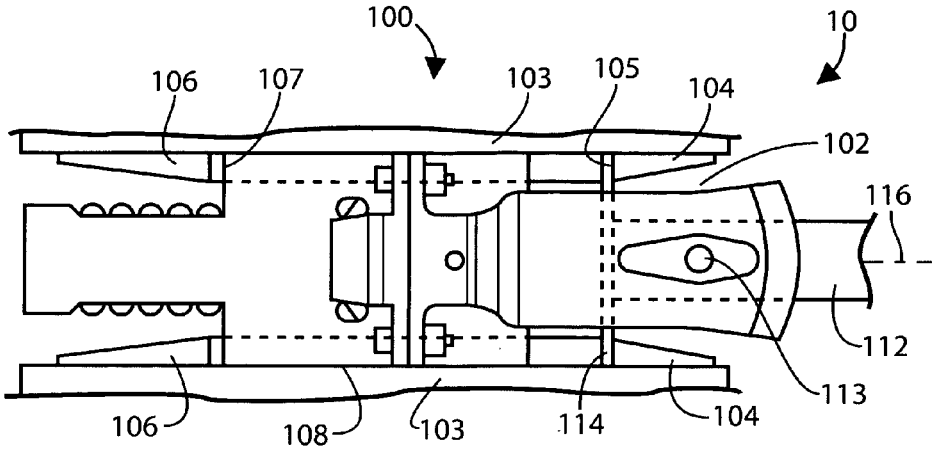
FIG. 1 is a plan view of a friction draft gear assembly of the present invention as installed in a railway car pocket, partially illustrated attached to a railway coupler.

DETAILED DESCRIPTION OF THE PRESENTLY PREFERRED AND ALTERNATIVE EMBODIMENTS OF THE INVENTION

Prior to proceeding to the more detailed description of the present invention, it should be noted that for the sake of clarity identical components, having identical functions have been identified with identical reference numerals throughout the several views illustrated in the drawing figures.

Figure 2:
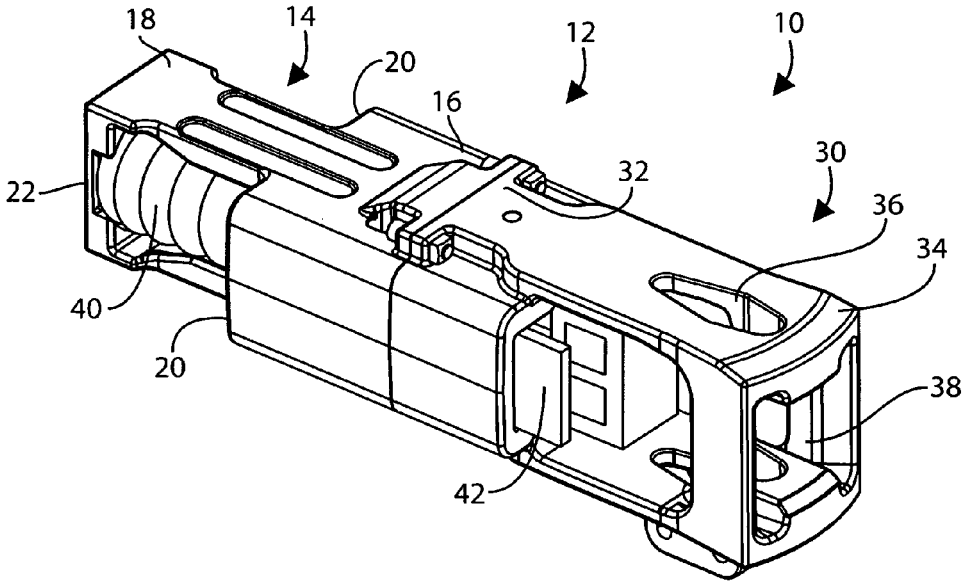
FIG. 2 is a perspective view of the friction draft gear assembly of the present invention.
Figure 3:
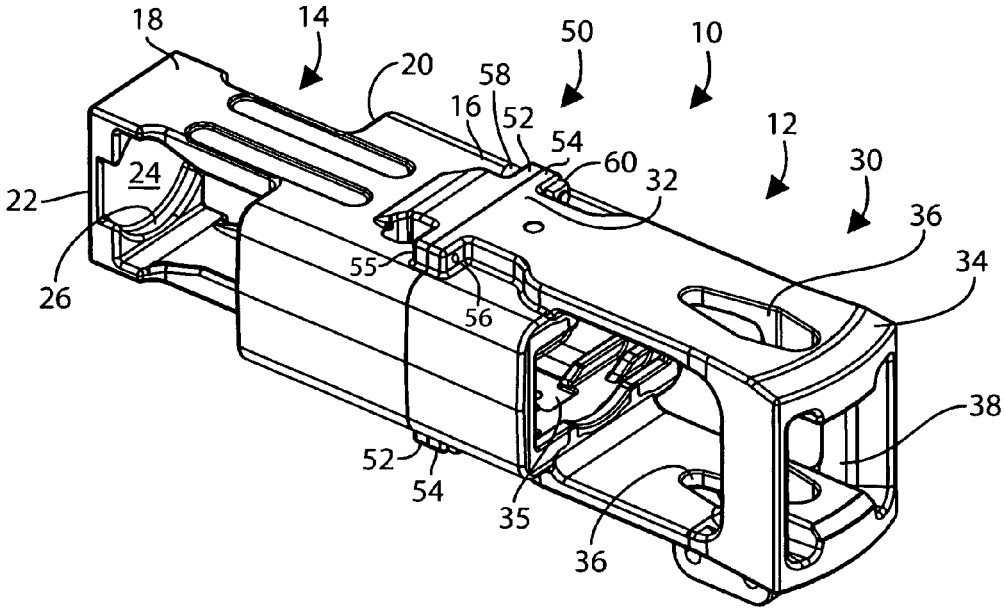
FIG. 3 is a perspective view of the friction draft gear assembly of FIG. 2, particularly showing the draft gear housing according to one embodiment of the invention.

Referring to one embodiment of the present invention, as shown in FIGS. 1-3, a friction-type draft gear assembly, generally designated 10, is disposed within a cavity 102 of a center sill, generally designated 100, of a railway car (not shown). A front stop 104 and an axially opposed rear stop 106 are attached to each side member 103 of the center sill 100 and form a draft gear pocket 108. Preferably, draft gear pocket 108 has a first predetermined length of about 24.625 inches.

A coupler arm 112 of a coupler (not shown) extends into the cavity 102 for attachment to the friction draft gear assembly 10 with a key 113. The coupler is generally disposed along the longitudinal axis 116 of the center sill 100. A front coupler follower 114 is disposed intermediate the coupler arm 112 and the friction draft gear assembly 10 and engages the working surfaces 105 of the front stops 104 for evenly transmitting the shock from the coupler thereto.

The friction draft gear assembly 10 includes a housing, generally designated 12, having a rear portion, generally designated 14, which is oriented towards the rear stops 106 and a front portion, generally designated 30, which is oriented towards the front stops 104.

The rear portion 14 has each of a predetermined shape and a predetermined length and has a first generally open end 16 and an axially opposed second end 18 oriented towards such pair of rear stops 106.

There is a pair of ledge members 20 having a predetermined width disposed intermediate the first and second rear ends 16 and 18 respectively which abut respective working surfaces 107 of the pair of the rear stops 106. Such pair of ledge members 20 enables the second end 18 of the rear portion 14 to extend into such sill 100 past the working surface 107 of the rear stops 106. It will be appreciated that such second end 18 will be at least partially disposed intermediate such rear stops 106.

The second end 18 includes a positioning means 26 engageable with an inner surface 24 of an end wall 22 of the second end 18 of the rear portion 14 for centrally maintaining one end of a resilient compressible cushioning element 40 which is disposed in the second end 18 during its compression and extension and which extends longitudinally from the inner surface 24 of the end wall 22 at least into the first end 16 of the rear portion 14. Such resilient compressible cushioning element 40 may include at least one of a spring element, hydraulic assembly, elastomeric pad stack, and various combinations thereof.

The end wall 22 may be removably attached or integral to the second end 18 of the rear portion 14.

The front portion 30 is axially opposed to the rear portion 14 and is maintained in open communication therewith. Such front portion 30 includes a generally open first end 32 having each of a predetermined shape and a predetermined length and is disposed adjacent the first end 16 of rear portion 14. An opposed generally open second end 34 of front portion 30 outwardly extends towards the pair of front stops 104 and has an aperture 38 configured for receiving the coupler arm 112.

A pair of vertically aligned coupler key apertures 36 is provided for attaching the front portion 30 to the coupler arm 112 with a vertically disposed pin 113.

Preferably, the first end 32 has an aperture 35 for receiving a seat means (not shown) having at least a portion of one surface thereof abutting an axially-opposite end of the compressible cushioning element 40 and mounted to move longitudinally within the housing 12 for respectively compressing and releasing the compressible cushioning element 40 during application and release of a force exerted on such draft gear assembly 10.

Such aperture 35 is further configured to receive a friction cushioning means 42 for absorbing energy during a compression of such draft gear assembly 10 and a spring release means (not shown) engaging and longitudinally extending between the seat means (not shown) and the friction cushioning means 42 for continuously urging the friction cushioning means 42 outwardly from the compressible cushioning element 40 to release the friction cushioning means 42 when an applied force compressing such draft gear assembly 10 is removed.

Alternatively, the rear portion 14 may be adapted for receiving the seat means (not shown) and at least a portion of the friction cushioning means 42.

The preferred compressible cushioning element 40, seat means and the friction cushioning means 42 are taught by U.S. Pat. Nos. 5,152,409, 5,529,194 and 5,590,797, whose teachings are incorporated herein by reference thereto. Alternatively, such elements may be those taught in U.S. Pat. No. 6,488,162, whose teachings are incorporated herein by reference thereto.

In this embodiment, the second end 34 of front portion 30 is configured as yoke member for attachment to an F-type coupler.

To removably attach front portion 30 to rear portion 16, the draft gear housing 12 is provided with attachment means, generally designated 50, which includes at least one first flange 52 outwardly extending from the first end 16 of the rear portion 14 and opposed at least one second flange 54 outwardly extending from the first end 32 of the front portion 30. The at least one second flange 54 has at least a portion thereof aligned with and abutting the at least one first flange 52. At least one first aperture 55 disposed within the at least one first flange 52 and an aligned at least one second aperture 56 disposed within the at least one second flange 54 are provided for receiving fastening means such as a bolt 58 and nut 60. In the presently preferred embodiment, the housing 12 has a pair of first flanges 52 and a pair of second flanges 54, each having a pair of aligned apertures 55 and 56, respectively.

Figure 4:
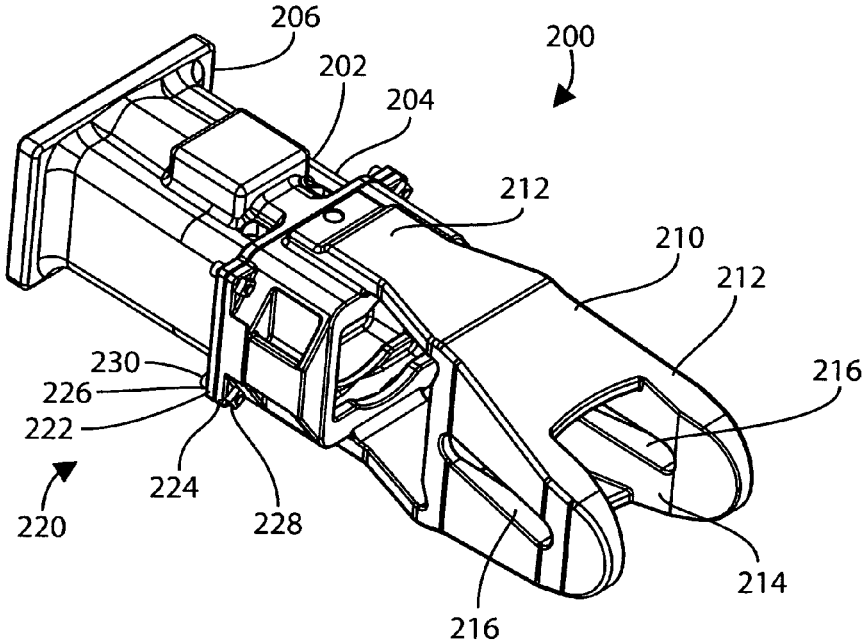
FIG. 4 is a perspective view of the friction draft gear housing according to another embodiment of the invention.

Now in reference to FIG. 4, therein shown is another embodiment of the housing, generally designated 200, which includes a rear portion 202 with a generally open first end 204 and a generally closed second end 206 and a front portion 210 with a generally open first end 212 and a generally open second end 216. The generally closed second end 206 abuts working surfaces 107 of the rear stops 106. The generally open second end 216 extends towards the pair of front stops 104 and includes an aperture 214 for receiving the coupler arm 112 and a pair of horizontally aligned coupler key apertures 216 for attachment to such coupler arm 112.

A means, generally designated 220, for removably attaching the front portion 210 to the rear portion 202 includes a plurality of aligned corner flanges 222 and 224 and plurality of aligned apertures 226 and 228 for receiving fastening means 230.

It will be understood that the second end 212 of such front portion 210 is configured as yoke member for attachment to an E-type coupler.

Figure 5:
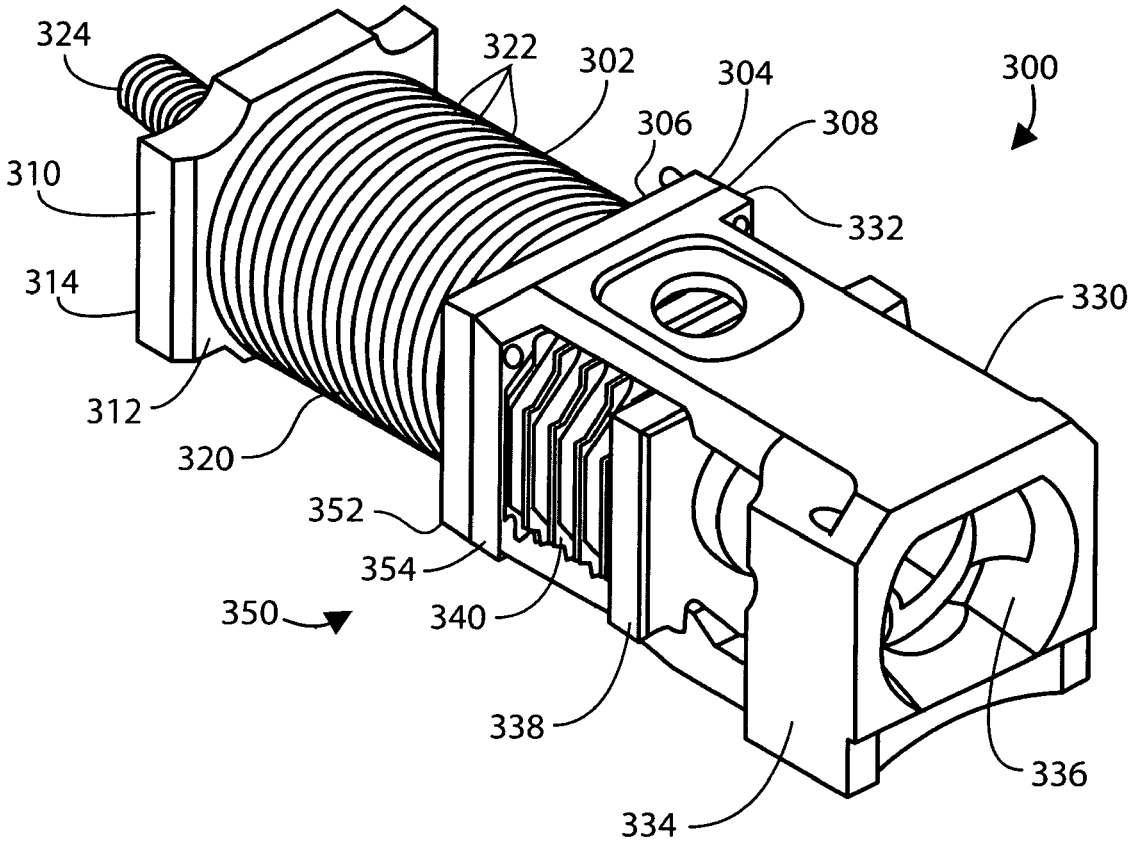
FIG. 5 is a perspective view of the friction draft gear assembly of yet another embodiment of the invention.

Now in reference to FIG. 5, therein shown another embodiment of the housing, generally designated 300, which includes a rear portion 302 with a first plate 304 defining a first end of the rear portion 302 and having each of a planar face surface portion 306 and a spaced back surface portion 308. Each of the face and back surfaces, 306 and 308 respectively, are disposed in a vertical plane when such draft gear assembly 10 is installed for cushioning such buff and draft shocks. A second plate 310 defines a second end of the rear portion 302 and has each of a planar face surface portion 312 and a spaced back surface portion 314. Each of the face and back surfaces, 312 and 314 respectively, are disposed in a vertical plane when such draft gear assembly 10 is installed for cushioning such buff and draft shocks. Back surface portion 314 abuts working surfaces 107 of the rear stops 106.

There is at least one resilient compression means 320 disposed intermediate the planar face surface portion 306 of the first end 302 and the planar face surface portion 312 of the second end 310. The at least one resilient compression means 320 is formed by a predetermined plurality of elastomeric pad members 322 according to the teaching of U.S. Pat. No. 6,446,820 incorporated into this document by reference thereto. A center rod 324 extends from the second end 310 through the at least one resilient compression means 320 and through the first end 302.

A front portion 330 has a first plate like end 332 and an outwardly extending second end 334 which is provided with an aperture 336 for receiving and retaining the coupler arm 112 of a rotary dump coupler (not shown).

There is a coupler follower 338 disposed within the front portion 330 intermediate the ends thereof and a second resilient compression means 340 according to the teaching of the U.S. Pat. No. 6,446,820 is caged between the first end 332 and the coupler follower 336.

An attachment means 350, preferably having a plurality of first corner flanges 352 extending from the first end 304 of the rear portion 302 and a complimentary plurality of second corner flanges 354 extending from the first end 332 of the front portion 330 are provided for removable attachment of the front portion 330 to the rear portion 302.

Although the present invention has been shown in terms of the removable attachment means utilizing flange members in the front and rear portions of the draft gear housing and which are fastened to each other, it will be apparent to those skilled in the art, that the present invention may be applied to other attachment means enabling removable attachment of the front portion. For example, a plurality of brace members fastened to both the front and rear portions may be used for such removable attachment of the front portion to the rear portion. Alternatively, such brace members may be rigidly attached or integral to one of the front and rear portions and fastened to an opposed one of such front and rear portions. Yet alternatively, a suitable clamp means may be provided instead of fastening means for removable attachment of the front portion to the rear portion.

It will be understood that removable attachment of the front portion according to the embodiments of the present invention enables ease of replacement of such front portion for reconditioning purposes as well as provides for ease of interchangeability of the front portion to cooperate with a particular coupler type.

Furthermore, the at least one resilient compression means 320 in FIG. 5 may be interchanged with the compressible cushioning element 40 best shown in FIG. 3 and the second resilient compression means 340 in FIG. 5 may be interchanged with the friction cushioning means 42 best shown in FIG. 3 with appropriate modifications of the front and rear portions of the draft gear housing.

Although a presently preferred and various alternative embodiments of the present invention have been described in considerable detail above with particular reference to the drawing FIGURES, it should be understood that various additional modifications and/or adaptations of the present invention can be made and/or envisioned by those persons skilled in the relevant art without departing from either the spirit of the instant invention or the scope of the appended claims.

We claim:

1. An assembly for a railway car draft gear assembly for cushioning buff and draft shocks that are encountered in such railway car rolling stock during a coupling operation of such railway car to a train consist and during operation of such train consist on a track structure, said assembly comprising:

(a) a rear portion having:

(i) a first plate defining a first end of said rear portion and having each of a planar face surface and a spaced apart planar back surface, each of said face and back surfaces disposed in a vertical plane when such draft gear assembly is installed for cushioning such buff and draft shocks, (ii) a second plate defining a second end of said rear portion and having each of a planar face surface and a spaced apart planar back surface, said planar back surface of said second end abutting a working surface of each of a pair of rear stops disposed on a center sill of a railway car, and said planar back surface of said first end is oriented towards a front portion, each of said face and back surfaces of said second plate disposed in a vertical plane when such draft gear assembly is installed for cushioning such buff and draft shocks, and (iii) a center rod extending from said first end of said rear portion through a center aperture formed through said second end of said rear portion;

(b) said front portion having each of a predetermined shape, a predetermined length, a first end with an outer surface thereof abuttingly engaging said planar back surface of said first end of said rear portion and an axially opposed generally open second end adapted for receiving a coupler arm;

(c) a quartet of first apertures, each of said quartet of first apertures formed through a thickness of said second plate adjacent one corner thereof;

(d) a quartet of second apertures, each of said quartet of second apertures formed through a thickness of said first end of said front portion adjacent one corner thereof and in alignment with a respective one of said quartet of first apertures;

(e) fasteners each of received within aligned first and second apertures and engageable with each of said first ends; and (f) at least one aperture disposed within said front portion for attaching said assembly to such coupler.

2. The assembly, according to claim 1, wherein said assembly includes at least one resilient compression member disposed intermediate said planar face surface of said first end of said rear portion and said planar face surface of said second end of said rear portion and wherein said center rod extends through said at least one resilient compression member.

3. The assembly, according to claim 1, wherein each of said fastener includes a threaded bolt and a threaded nut.

4. The assembly, according to claim 1, wherein said at least one aperture for attaching said assembly to such coupler includes a pair of aligned coupler key apertures.

5. A draft gear assembly for cushioning buff and draft shocks that are usually encountered in such railway car rolling stock during a coupling operation of such railway car to a train consist and during normal operation of such train consist on a track structure, such buff and draft shocks transmitted by a coupler of such railway car, such draft gear assembly engageable within a center sill of such railway car between a pair of front stops and an axially opposed pair of rear stops, said draft gear assembly comprising:

(a) a rear portion having each of a predetermined shape and a predetermined length and further having a first plate defining a first end of said rear portion and having each of a planar face surface and a spaced apart planar back surface, a second plate defining a second end of said rear portion and having each of a planar face surface and a spaced apart planar back a center rod extending from said first end of said rear portion through a center aperture formed through said second end of said rear planar back surface of said second end abutting a working surface of each of a pair of rear stops disposed on a center sill of a railway car, and said planar back surface of said first end is oriented towards a front portion, each of said face and back surfaces of reach of said front and rear portions disposed in a vertical plane when such draft gear assembly is installed for cushioning such buff and draft shocks, (b) said front portion having each of a predetermined shape, a predetermined length, an outer surface of a first end of said front portion abuttingly engaging said planar back surface of said first end of said rear portion and an axially opposed generally open second end adapted for receiving a coupler arm, (c) a quartet of first apertures, each of said quartet of first apertures formed through a thickness of said second plate adjacent one corner thereof, (d) a quartet of second apertures, each of said quartet of second apertures formed through a thickness of said first end of said front portion adjacent one corner thereof and in alignment with a respective one of said quartet of first apertures;

(f) fasteners each of received within aligned first and second apertures and engageable with each of said first ends; and (g) at least one aperture disposed within said front portion for attaching said assembly to such coupler;

(h) a first compressible cushioning element disposed in said rear portion during compression and extension of said compressible cushioning element, wherein said center rod extends through said first resilient compression member; and (l) a second compressible cushioning element disposed in said front portion intermediate said first end and a coupler arm.

6. The draft gear assembly, according to claim 5, wherein said draft gear assembly further includes a coupler follower disposed in said front portion intermediate said first and said second end thereof.

* * * * *